US006374068B1

(12) United States Patent
Nakaue et al.

(10) Patent No.: US 6,374,068 B1
(45) Date of Patent: Apr. 16, 2002

(54) PART-REPLACEMENT AID TOOL AND IMAGE FORMING APPARATUS TO WHICH THE SAME IS ATTACHABLE

(75) Inventors: Takahisa Nakaue; Kazuo Joroku; Yoshizo Kawamori; Tsutomu Ashikari; Kiyomi Kayama; Takehiro Minami, all of Osaka (JP)

(73) Assignee: Kyocera Mita Corporation, Osaka (JP)

( * ) Notice: Subject to any disclaimer, the term of this patent is extended or adjusted under 35 U.S.C. 154(b) by 0 days.

(21) Appl. No.: 09/620,911

(22) Filed: Jul. 20, 2000

(30) Foreign Application Priority Data

Jul. 23, 1999 (JP) ..... 11-209488

(51) Int. Cl.[7] ..... G03G 15/00
(52) U.S. Cl. ..... 399/110; 399/111; 399/262
(58) Field of Search ..... 399/110, 111, 399/258, 262, 116, 117, 98, 99, 393; 271/145

(56) References Cited

U.S. PATENT DOCUMENTS 3,604,797 A * 9/1971 Szczesniak ..... 399/116
3,888,577 A * 6/1975 Meyer ..... 399/116
4,766,455 A * 8/1988 Carter ..... 399/116
5,999,771 A * 12/1999 Wakihara ..... 399/117
6,175,704 B1 * 1/2001 Yamamoto ..... 399/116
6,185,395 B1 * 2/2001 Lee ..... 399/116

FOREIGN PATENT DOCUMENTS

JP 63-106236 * 5/1988
JP 06-242677 * 9/1994

* cited by examiner

*Primary Examiner*—Robert Beatty
(74) *Attorney, Agent, or Firm*—Smith, Gambrell & Russell, LLP

(57) ABSTRACT

An aid tool used for aiding in replacement operation of a part to be replaced in an image forming apparatus. This aid tool includes: a part holding unit for holding a part to be replaced; and a mounting portion for removably mounting the part holding unit on an image forming apparatus. The part holding unit is for example a part housing container for housing a part, and may also serve as a packaging container which houses a new replacing part. The part housing container may include, for example, a main body for receiving the part to be replaced, and a lid for openably closing the main body.

14 Claims, 8 Drawing Sheets

PART-REPLACEMENT AID TOOL AND IMAGE FORMING APPARATUS TO WHICH THE SAME IS ATTACHABLE

BACKGROUND OF THE INVENTION

1. Field of the Invention

The present invention relates to an aid tool for aiding in replacement operation of a part to be replaced of an image forming apparatus, and also relates to an image forming apparatus to which this aid tool can be attached.

2. Description of Related Art

Removably attached to an image forming apparatus such as a facsimile or the like are a number of parts such as an image forming unit including a photoreceptor drum and a developing roller, a toner cartridge for supplying toner, and the like.

The toner cartridge is arranged to supply, as necessary, toner to the developing device. When the toner in the developing device is fully consumed, the emptied toner cartridge is replaced with a new toner cartridge, causing the toner therein to be supplied. For replacing the used toner cartridge, the operator opens, for example, the shell of the main body of the image forming apparatus. Then, the operator takes out the used toner cartridge from the predetermined cartridge fitting portion to the outside of the main body of the image forming apparatus, and then mounts a new toner cartridge on the cartridge fitting portion. This means that the used toner cartridge is temporarily placed around the image forming apparatus.

Toner is sticking to the used toner cartridge at its outer surface. Accordingly, when the used toner cartridge is placed around the image forming apparatus, this involves the likelihood that the articles therearound are made dirty with the toner. Further, in the course of the used toner cartridge from the removal to the placement, toner falls from the toner cartridge to the outside of the main body of the image forming apparatus. This results in contamination of the articles around the image forming apparatus.

Further, the longer is the path from the cartridge fitting portion to the place where the used toner cartridge is temporarily put, the higher is the possibility of the toner contaminating the articles around the path and the fingers and clothes of the operator. In particular, when there is no suitable temporarily putting place around the image forming apparatus, it is very hard to avoid toner contamination.

As to the replacement of other part to be replaced such as an image forming unit or the like, too, when there is no suitable temporarily putting place around the image forming apparatus, the replacement cannot be executed with high efficiency.

SUMMARY OF THE INVENTION

It is an object of the present invention to provide an aid tool for successfully aiding in replacement operation of a part to be replaced of an image forming apparatus, and also to provide an image forming apparatus in which a part to be replaced can successfully be replaced.

The aid tool according to the present invention comprises: a part holding unit for holding a part to be replaced; and a mounting portion for removably mounting the part holding unit on an image forming apparatus (at its main body for example).

According to the arrangement above-mentioned, when the mounting portion of this aid tool is mounted on an image forming apparatus, the part holding unit is attached thereto.

Accordingly, when the aid tool is attached to the image forming apparatus at the time of part replacement, a place where the part to be replaced is to be temporarily put, can be prepared in the vicinity of the image forming apparatus. More specifically, the part to be replaced as removed from the image forming apparatus or a replacing part to be attached thereto, can be held by the part holding unit. This advantageously shortens the distance by which the part to be replaced is moved. Further, even though a suitable part temporarily putting place cannot be assured around the image forming apparatus, the part replacement can efficiently be executed.

The part to be replaced may be a toner cartridge. In this case, at the time of cartridge replacement, the used toner cartridge taken out from the image forming apparatus, can be held by the part holding unit attached thereto. This prevents the circumference around the image forming apparatus from being contaminated by the toner at the time of replacement of the toner cartridge.

The part to be replaced may be an image forming unit having a photoreceptor and a developing unit.

The part to be replaced may be a fixing roller for fixing a transferred toner image onto paper, or a recovery tank disposed at the toner recovery unit of the image forming unit for accumulating the toner collected from the photoreceptor. Often, toner is sticking to the outer surface of such a part as taken out from the image forming apparatus. Accordingly, when such a part is placed outside of the image forming apparatus, this contributes to contamination by toner. The present invention can also be applied to an aid tool for aiding in replacement of other part to be replaced than those above-mentioned, as far as such a part is removably attached to the image forming apparatus.

Preferably, the part holding unit is a part housing container having a housing space for housing the part to be replaced. According to the arrangement above-mentioned, the part to be replaced is housed in the housing space formed in the part housing container at the time of part replacement.

In the arrangement above-mentioned, the part housing container preferably also serves as a packaging container for housing a new replacing part. In this case, at the time of part replacement, the operator can attach, to the image forming apparatus, the part housing container from which a new part has been taken out, and can put the used part in the housing space thus emptied. More specifically, the used part can be held by the container in which a new part has been packaged. This enables part replacement to be executed without the circumference around the image forming apparatus contaminated.

Preferably, the part housing container comprises a main body for receiving the part to be replaced, and a lid which openably closes the housing space with respect to the main body, and the mounting portion is disposed at the main body.

According to the arrangement above-mentioned, when the mounting portion disposed at the main body is mounted on the image forming apparatus, the part housing container is attached thereto. At the time of part replacement, the part to be replaced is received by the main body.

Preferably, the part housing container also serves as a packaging container in which a new replacing part is housed. In this case; the part housing container having a housing space opened after the new part has been taken out, can be attached, as it is,to the image forming apparatus. This enables part replacement to be more rapidly executed.

By closing the lid after the used part has been housed, the used part can be handled with no trouble of toner contamination.

Preferably, the aid tool further comprises a reception portion arranged such that when the aid tool is attached to the image forming apparatus, the reception portion receives, under the path of the part to be replaced from the fitting portion of the part to be replaced in the image forming apparatus to the part holding unit, a thing falling from the part to be replaced.

According to the arrangement above-mentioned, even though a falling thing such as toner or the like falls from the part to be replaced while the same is moved from the fitting portion of the image forming apparatus to the part holding unit, this reception portion receives such a falling thing. This prevents the circumference around the image forming apparatus from being contaminated by a falling thing at the time of part replacement.

The reception portion may be disposed at the main body, and the mounting portion may be disposed at the reception portion.

An image forming apparatus of the present invention comprises an engagement portion engageable with and disengageable from the mounting portion of the part-replacement aid tool above-mentioned.

According to the arrangement above-mentioned, the mounting portion of the part-replacement aid tool is engaged with the engagement portion of the image forming apparatus such that the part holding unit is attached thereto. Accordingly, when the part holding unit is attached to the image forming apparatus at the time of replacement of the part to be replaced, there can be provided, in the vicinity of the image forming apparatus, a place where the part to be replaced is temporarily put. More specifically,the part holding unit can hold the part to be replaced as taken out from the image forming apparatus or the new replacing part to be attached thereto. This advantageously not only shortens the distance by which the part to be replaced is moved, but also enables part replacement to be efficiently executed even though a suitable part temporarily putting place cannot be assured around the image forming apparatus.

Preferably, the engagement portion is fixed to the image forming apparatus at least at the time of replacement of the part to be replaced.

According to the arrangement above-mentioned, when the part-replacement aid tool is attached to the engagement portion, a part temporarily putting place can securely be provided in the vicinity of the image forming apparatus.

The engagement portion may be disposed at the main body housing of the image forming apparatus.

The engagement portion may be disposed at a unit which is removably attached to the main body housing of the image forming apparatus and which has a fitting portion for the part to be replaced.

When the part to be replaced is a toner cartridge, the unit having the fitting portion for the part to be replaced, may be an image forming unit which has a photoreceptor and a developing unit and on which a toner cartridge can be mounted.

Preferably, the engagement portion is disposed such that the part holding unit is positioned in the vicinity of the fitting portion for the part to be replaced. In this case, the part holding unit is positioned, in the image forming apparatus, in the vicinity of the fitting portion for the part to be replaced. More specifically, the distance by which the part to be replaced is moved from the fitting portion to the part holding unit at the time of part replacement, is short. Thus, the part to be replaced can readily be held by the part holding unit. Further, the contamination by toner or the like can be minimized.

One of the mounting portion and the engagement portion may be a hook, and the other of the mounting portion and the engagement portion may be an engagement hole with which the hook is engaged.

According to the arrangement above-mentioned, the engagement of the hook with the engagement hole enables the part holding unit to be attached to the image forming apparatus.

Preferably, the engagement hole comprises a fitting hole extending in one direction, and a coming-out preventing hole having a narrow width and extending from the fitting hole in a direction substantially at a right angle to the direction in which the fitting hole extends. Preferably, the hook to be engaged with the fitting hole, comprises a standing portion extending substantially upright from the top surface of the image forming apparatus, and a bent portion which is bent from the tip of the standing portion.

Preferably, the mounting portion of the part holding unit is an engagement hole, and the engagement portion of the image forming apparatus is a hook. This is because it is easier to form an engagement hole than to form a hook when the part holding unit is made by machining a sheet.

These and other features, objects and advantages of the present invention will be more fully apparent from the following detailed description set forth below when taken in conjunction with the accompanying drawings.

DESCRIPTION OF THE PREFERRED EMBODIMENTS

Figure 1:
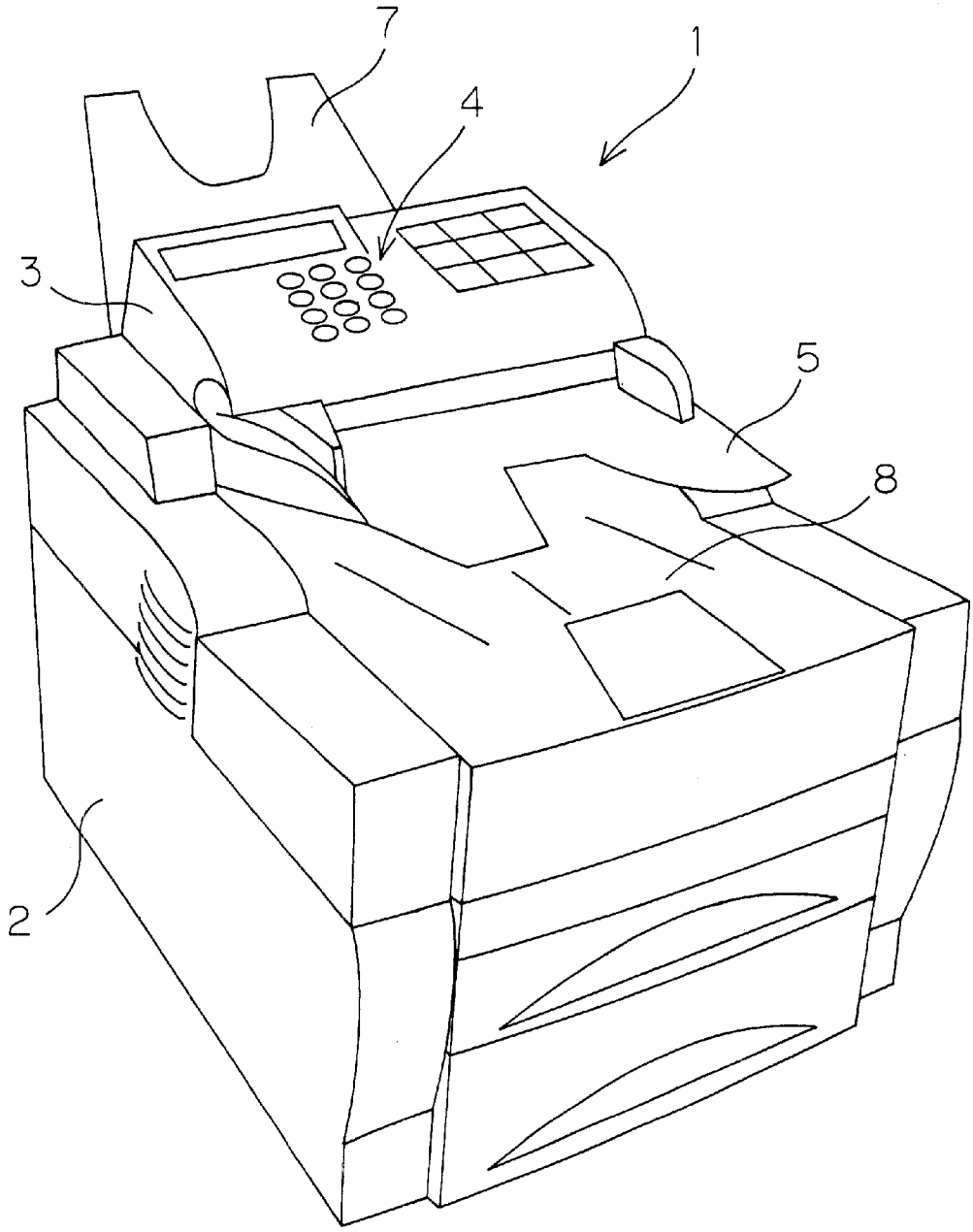
FIG. 1 is a perspective view illustrating the arrangement of the external appearance of an image forming apparatus according to an embodiment of the present invention.

FIG. 1 is a perspective view of an image forming apparatus 1 according to an embodiment of the present invention. This image forming apparatus 1 is of the multifunctional type which is basically used as a facsimile machine and which also serves as a printer or a copying machine. The image forming apparatus 1 comprises a main body housing 2 and a document reading unit 3 disposed at an upper portion of the main body housing 2. The document reading unit 3 is provided on the top thereof with an operation board 4 on which ten-keys, function keys, a display and the like are arranged. A document setting tray 5 projects in front of the document reading unit 3 (toward this side at the right hand in FIG. 1). Documents placed on the document setting tray 5 are to be taken in one by one in a so-called sheet-through manner, and then received, after the contents thereof have been read, by a document receiving tray 7 disposed at the rear side.

The top surface of the main body housing 2 positioned under the document setting tray 5 serves as a discharge stand 8 for receiving paper having thereon a reproduced image.

Figure 2:
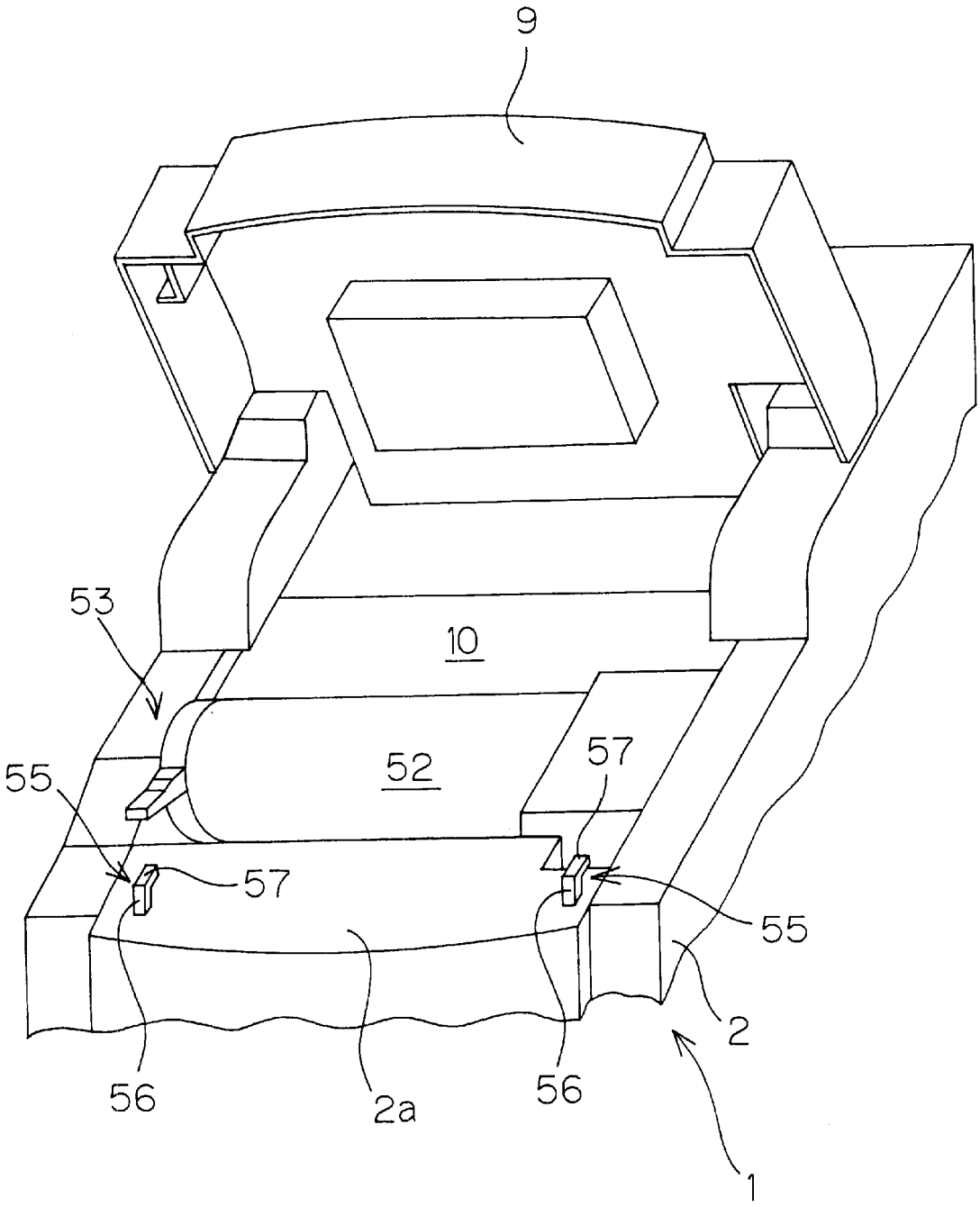
FIG. 2 is a schematic perspective view of the image forming apparatus in FIG. 1 with the shell of the main body housing thereof opened.

FIG. 2 is a perspective view of the main body housing 2 with its shell 9 opened. An image forming unit 10 is removably attached inside of the main body housing 2.

Figure 3:
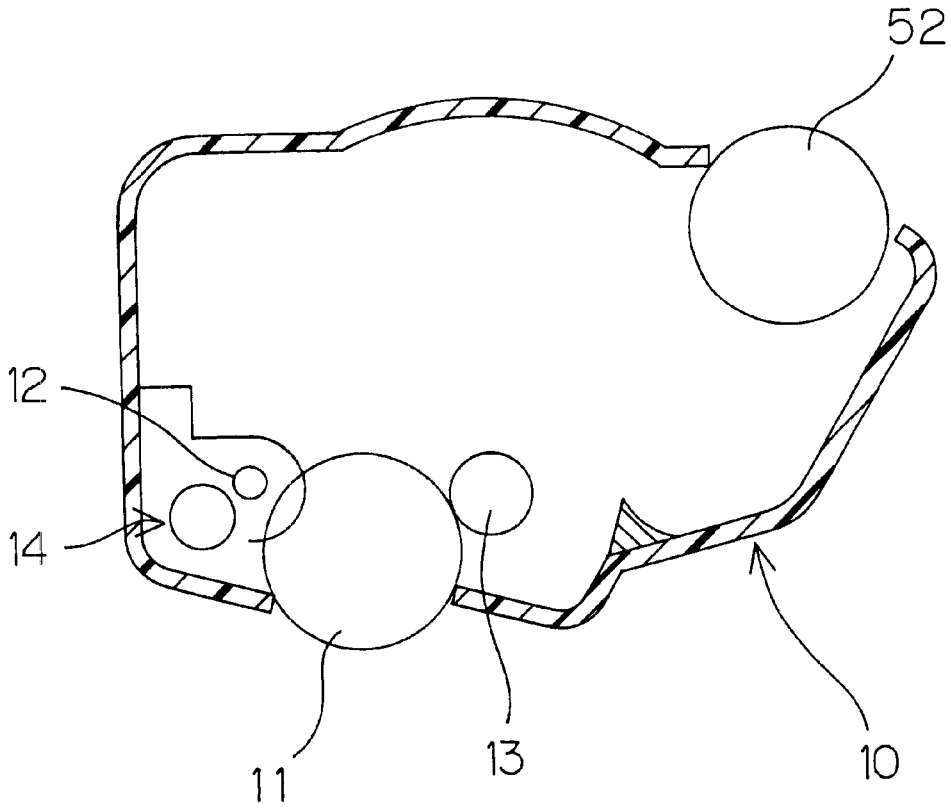
FIG. 3 is a section view of main portions of the image forming unit of the image forming apparatus in FIG. 1.

Referring to FIG. 3, the image forming unit 10 comprises a photoreceptor drum 11 on which an electrostatic latent image is to be formed, a main charger 12 for electrically charging the surface of the photoreceptor drum 11, a developing roller 13 for developing the electrostatic latent image on the surface of the photoreceptor drum 11 with toner, and a toner recovery unit 14 for collecting the toner stuck onto the surface of the photoreceptor drum 11. This image forming unit 10 is removably attached to the main body housing 2. A toner cartridge 52 (a part to be replaced) is removably mounted on the image forming unit 10. To write an electrostatic latent image on the surface of the photoreceptor drum 11 uniformly electrically charged by the main charger 12, a laser scanning unit (not shown) is disposed in the main body housing 2.

The image forming unit 10 may comprise at least the photoreceptor drum 11 and the developing roller 13, and other component elements such as the main charger 12 and the like may be disposed at the main body housing 2 of the image forming apparatus 1.

Referring to FIG. 2, the image forming unit 10 has a fitting portion 53 on which a toner cartridge 52 is mounted. As shown in FIG. 2, the toner cartridge 52 mounted on the fitting portion 53 is exposed at its upper part when the shell 9 is opened.

This image forming apparatus 1 is arranged such that with the shell 9 opened, the image forming unit 10 or the toner cartridge 52 can be replaced and paper jam can be solved.

The toner cartridge 52 is removably mounted on the fitting portion 53 for supplying, as necessary, toner to the developing roller 13. When the toner in the image forming unit 10 is fully consumed, the emptied toner cartridge 52 is replaced with a new toner cartridge 52A (See FIG. 4).

This embodiment is characterized in that at the time of replacement of the toner cartridge 52, a housing container 58 from which a new toner cartridge 52A has been removed (See FIGS. 4 and 5), is attached to the main body housing 2 such that the used toner cartridge 52 is to be held by this housing container 58.

The main body housing 2 is provided on the top surface 2*a* thereof with a pair of engagement portions 55 with the use of which the housing container 58 is attached to the main body housing 2.

Each of the engagement portions 55 is a hook comprising a standing portion 56 extending substantially upright from the top surface 2*a* of the main body housing 2, and a bent portion 57 extending from the tip of the standing portion 56 to the inner part of the main body housing 2.

Figure 4:
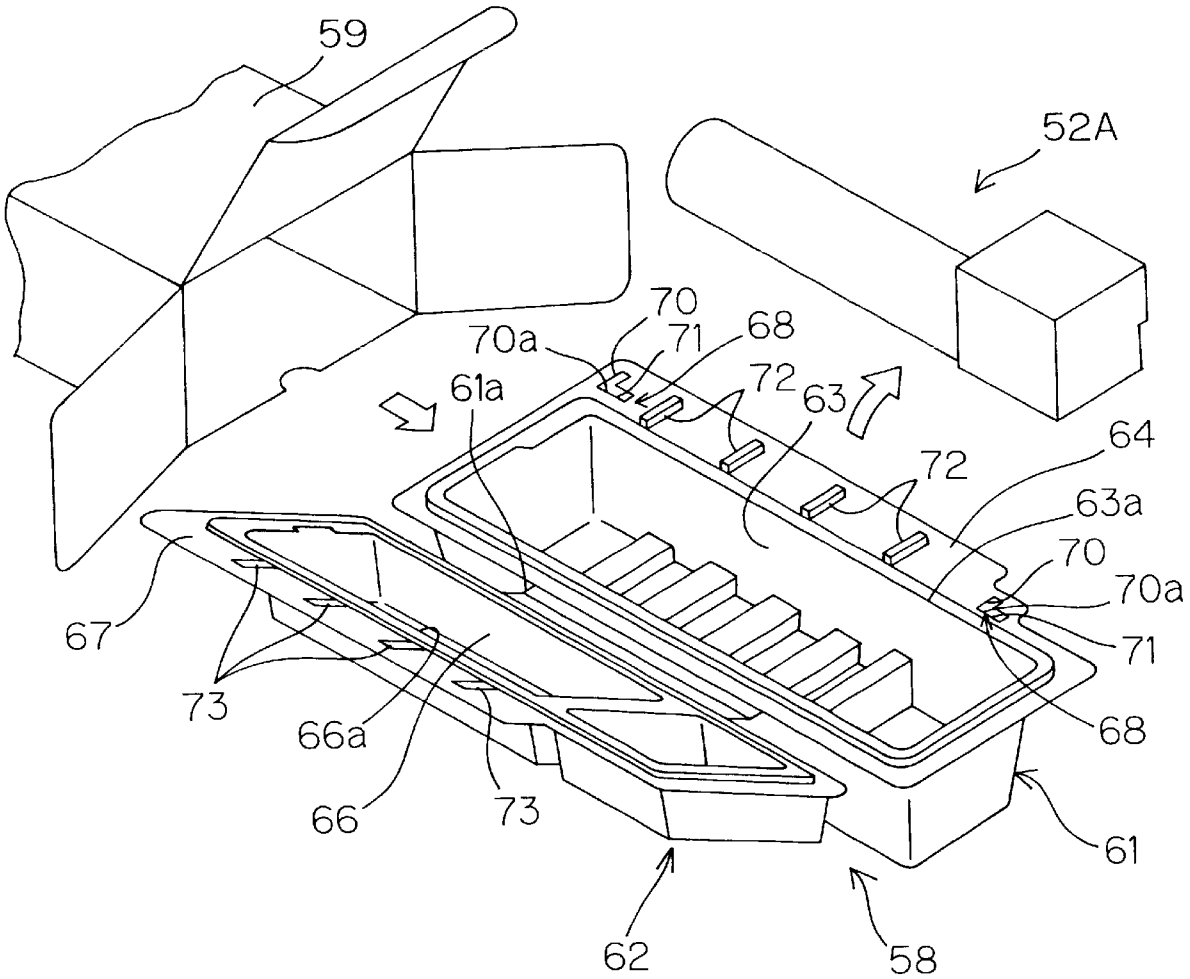
FIG. 4 is a perspective view of a housing container.

FIG. 4 is a perspective view illustrating the housing container 58.

The new toner cartridge 52A is housed, as packed in the housing container 58, in a housing box 59.

The housing container 58 is formed by machining a polyethylene sheet, and comprises a main body 61 for receiving the toner cartridge 52A, and a lid 62 held by an edge 61*a* of the main body 61 in a manner rotatable around this edge 61*a*.

The main body 61 has a first receiving portion 63 which is concaved and opened at its top, and a reception portion 64 extending substantially horizontally from the upper edge 63*a* of the first receiving portion 63. The lid 62 has a second receiving portion 66 swelling in the upward direction, and an extending portion 67 extending from the edge 66*a* of the second receiving portion 66 toward the circumference thereof. The housing container 58 is arranged such that when the lid 62 is closed with respect to the main body 61, the first receiving portion 63 and the second receiving portion 66 define a space for housing the toner cartridge 52A.

In the vicinities of the both ends of the reception portion 64, there are formed a pair of mounting portions 68 which are engaged with the engagement portions 55 when the housing container 58 is attached to the main body housing 2. Each of the mounting portions 68 is an engagement hole substantially in the L shape. Each mounting portion 68 of the housing container 58 is made in the form of an engagement hole for the following reason. In the housing container 58 formed by machining a sheet body, it is easier to form an engagement hole than to form a hook.

Each mounting portion 68 comprises a fitting hole 70 which extends in one direction and in which the bent portion 57 is to be fitted, and a coming-out preventing hole 71 which extends from the rear end 70*a* of the fitting hole 70 in the direction substantially at a right angle to the fitting-hole extending direction and which has such a width as to prevent the bent portion 57 from passing through.

In the vicinities of the pair of mounting portions 68, the reception portion 64 has a plurality of (four in this embodiment) engagement projections 72 for holding the lid 62 as closed. The extending portion 67 has a plurality of engagement grooves 73 which are to be fitted to and engaged with the engagement projections 72 when the lid 62 is closed.

At the time of toner cartridge replacement, a new toner cartridge 52A housed in the housing box 59 is first taken out as packed in the housing container 58. Then, the engagement grooves 73 are disengaged from the engagement projections 72, the lid 62 is rotated such that the housing space is opened, and the toner cartridge 52A housed in the first receiving portion 63 of the main body 61 is taken out in the upward direction. The new toner cartridge 52A thus taken out is once placed, for example, at a suitable position around the image forming apparatus 1. There is no possibility of this new toner cartridge 52A contaminating the circumference around the image forming apparatus 1 because the toner housing space is hermetically sealed. Then, the housing container 58 is attached to the main body housing 2.

Figure 5:
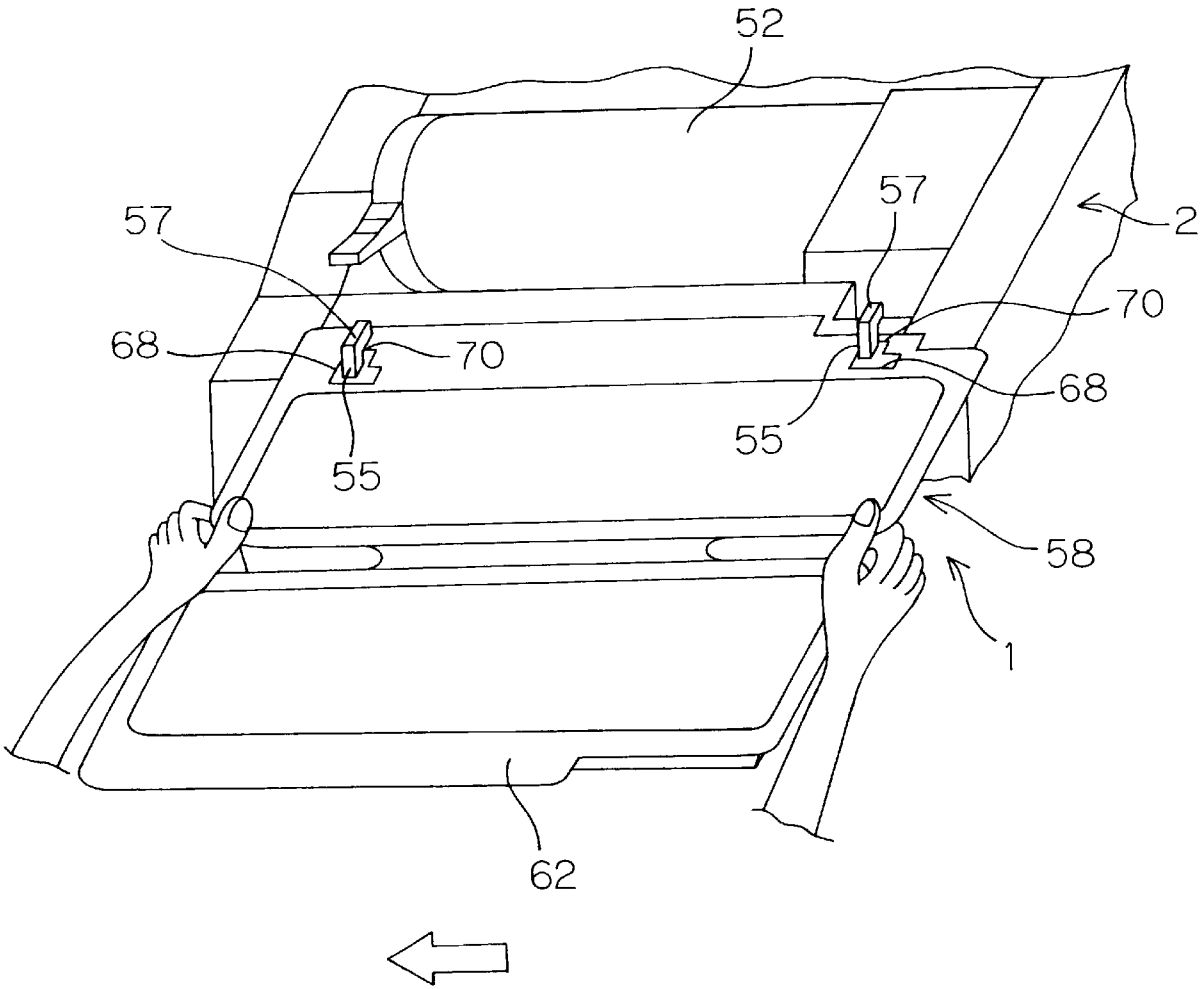
FIG. 5 is a perspective view illustrating how to attach the housing container to the main body housing.

FIG. 5 is a perspective view illustrating how the housing container 58 is attached to the main body housing 2. With the lid 62 opened after the toner cartridge 52A has been taken out, the housing container 58 is attached to the main body housing 2. The operator positions the housing container 58 such that the mounting portions 68 are opposite to the engagement portions 55 of the main body housing 2. Then, the operator hooks the mounting portions 68 on the corresponding engagement portions 55. More specifically, the fitting holes 70 of the mounting portions 68 are fitted to the bent portions 57 of the engagement portions 55, and the housing container 58 is then slid in one direction (shown by a white arrow in FIG. 5).

Figure 6:
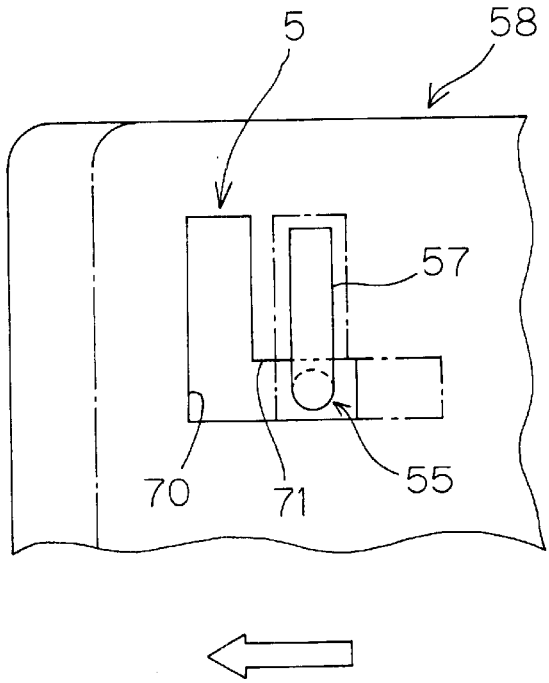
FIG. 6 is an enlarged plan view of portions of the housing container attached to the main body housing.
Figure 7:
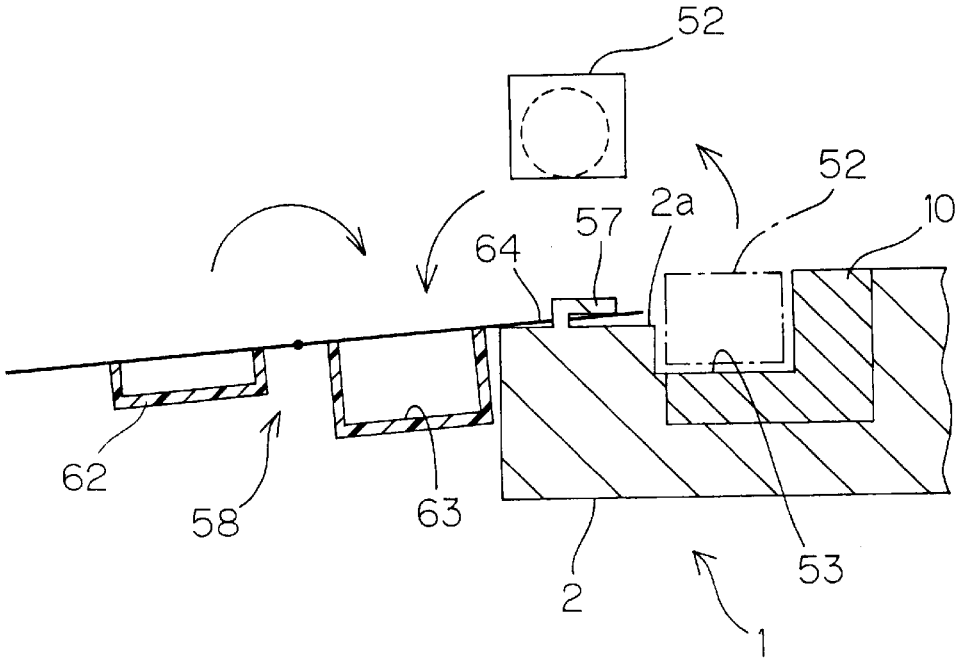
FIG. 7 is a section view, illustrating the attachment of the housing container to the main body housing.

FIG. 6 is an enlarged plan view of portions of the housing container 58 as attached to the main body housing 2. When the housing container 58 is slid leftwards, the standing portions 56 of the engagement portions 55 are fitted in the coming-out preventing holes 71. The coming-out preventing holes 71 have such a width as to prevent the bent portions 57 of the engagement portions 55 from passing through. This securely prevents the engagement portions 55 from coming out from the mounting portions 68. At this time, both the tips of the bent portions 57 and the rear end of the top surface 2*a* of the main body housing 2, come in contact with the reception portion 64, as shown in FIG. 7. This achieves the attachment of the housing container 58 to the main body housing 2.

After the housing container 58 has been attached to the main body housing 2, the used toner cartridge 52 mounted on the fitting portion 53 is removed therefrom and put in the housing space of the housing container 58. More specifically, the operator holds the used toner cartridge 52, removes the same from the main body housing 2, and put the same in the first receiving portion 63 of the housing container 58 attached to the main body housing 2.

As shown in FIG. 7, when the used toner cartridge 52 is moved from the fitting portion 53 to the first receiving portion 63, the reception portion 64 is operated to receive, under the toner-cartridge path from the fitting portion 53 to the first receiving portion 63, toner particles falling from the toner cartridge 52. Accordingly, at the time of cartridge replacement, the main body housing 2 and the articles therearound are not made dirty by falling toner particles.

After the used toner cartridge 52 is set to the first receiving portion 63, the new toner cartridge 52A previously placed around the image forming apparatus 1 is mounted on the fitting portion 53.

On the other hand, in the housing container 58, the lid 62 is rotated to close the housing space. The engagement projections 72 are engaged with and fitted to the engagement grooves 73 such that the lid 62 is joined to the main body 61. Then, the mounting portions 68 are disengaged from the engagement portions 55, and the used toner cartridge 52 is collected as packed in the housing box 59.

According to the arrangement above-mentioned, at the time of the replacement of toner cartridge, the new toner cartridge 52A can be mounted with the used toner cartridge 52 removed from the main body housing 2 being held by the housing container 58 attached to the main body housing 2. More specifically, it is not required to temporarily place the used toner cartridge 52 removed from the main body housing 2 on the floor or the like around the image forming apparatus 1. This prevents the circumference around the image forming apparatus 1 from being contaminated by toner particles at the time of the replacement of toner cartridge.

Further, the replacement of the used toner cartridge 52 is executed with the used toner cartridge 52 removed from the main body housing 2 being temporarily placed in the first receiving portion 63 located in the vicinity of the fitting portion 53. Thus, the moving distance of the used toner cartridge 52 is short. This not only facilitates the replacement of toner cartridge, but also minimizes the contamination of operator's fingers and clothes by toner particles.

Figure 8:
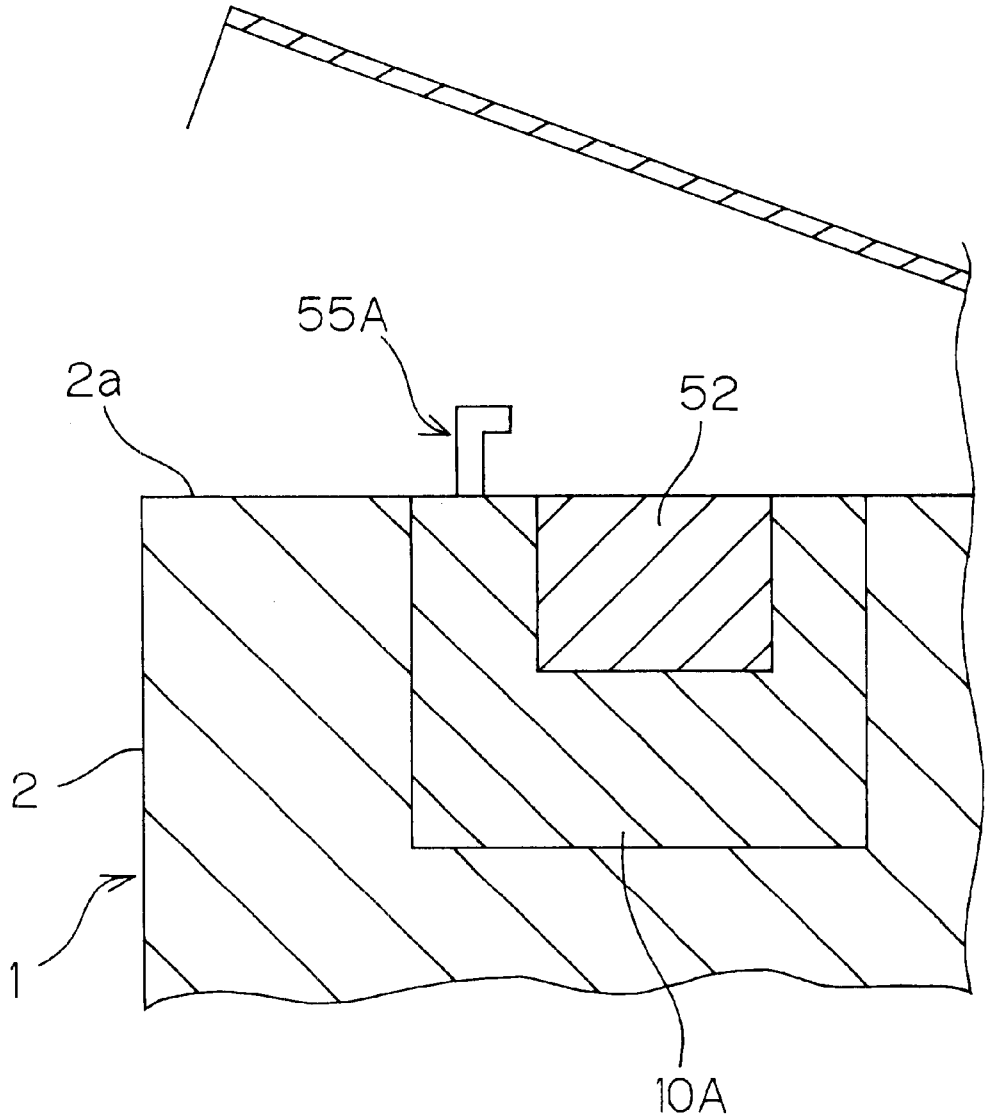
FIG. 8 is a view illustrating another embodiment of the present invention.

In the embodiment in FIG. 2, the engagement portions 55 are disposed at the top surface of the main body housing 2. As shown in FIG. 8, however, the engagement portions may be disposed at an image forming unit 10A which is mounted on the main body housing 2 at least at the time of cartridge replacement. In the embodiment in FIG. 8, the mounting portions 68 of the housing container 58 can be engaged with the engagement portions 55A disposed at the image forming unit 10A to attach the housing container 58 to the main body housing 2. This enables the used toner cartridge 52 to be held by the housing container 58 attached to the main body housing 2 at the time of cartridge replacement.

In the embodiments above-mentioned, the mounting portions 68 of the housing container 58 are made in the form of engagement holes and the engagement portions 55, 55A are made in the form of hooks. However, the engagement portions 55, 55A may be made in the form of engagement holes and the mounting portions 68 may be made in the form of hooks.

Each of the embodiments above-mentioned is arranged such that the housing container 58 is attached to the main body housing 2 by the combination of the hooks with the engagement holes. However, such an attachment may be made with the use of hook-and-loop fasteners.

Figure 9:
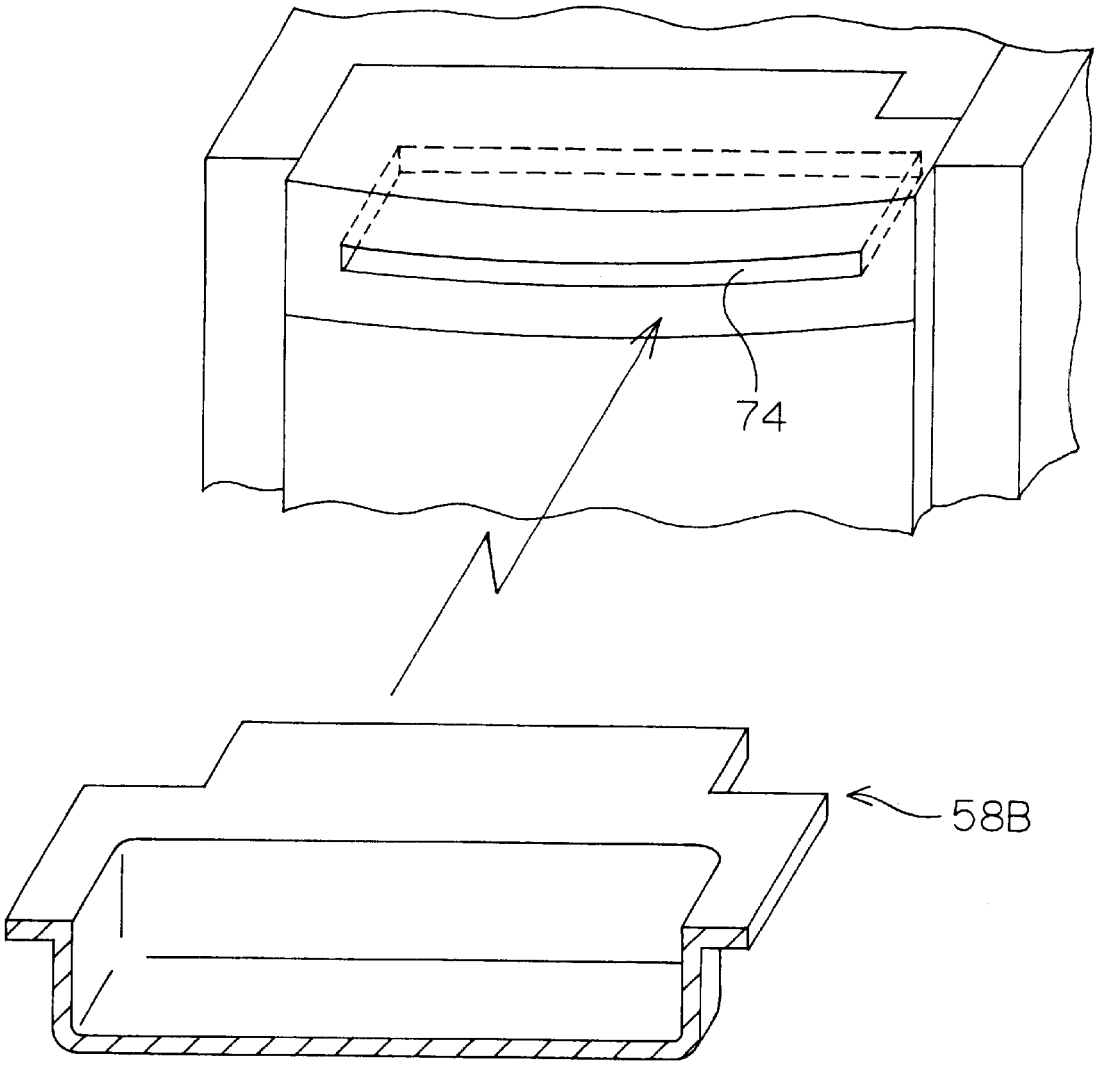
FIG. 9 is a view illustrating a further embodiment of the present invention.

As shown in FIG. 9, a slit-like concaved portion 74 may be formed in the main body housing 2, and a portion of a housing container 58B may be inserted into this concaved portion 74 such that the housing container 58B is attached to the main body housing 2.

In each of the embodiments above-mentioned, the housing container 58, 58B is a packaging container which houses the new toner cartridge 52A. However, provision may be made such that there is prepared, in addition to the packaging container, an aid tool which is to be removably held by the image forming apparatus 1 and which offers a place where the used toner cartridge 52 is to be put.

Further, the present invention can be applied to a container for housing the image forming unit 10.

Often, there are instances where toner particles are sticking to the outer surface of the fixing roller, the recovery tank or the like. Thus, the present invention can also be applied to a container for housing such a component part which is not desired to be directly placed on the floor or the like. It is enough that the aid tool can hold a part to be replaced which is attached to the image forming apparatus. Thus, the aid tool is not necessarily made in the form of a container, but may be made in the form of a tray.

Embodiments of the present invention have been discussed in detail, but these embodiments are mere specific examples for clarifying the technical contents of the present invention. Therefore, the present invention should not be construed as limited to these specific examples. The spirit and scope of the present invention are limited only by the appended claims.

This application claims priority benefits under 35 USC §119 of Japanese Patent Application Serial No. 11-209488, filed on Jul. 23, 1999, the disclosure of which is incorporated herein by reference.

What we claim is:

1. A part-replacement aid tool used for aiding in a replacement operation of a part to be replaced in an image forming apparatus, comprising:

a part holding unit for holding a part to be replaced, wherein the part holding unit is a part housing container having a housing space for housing the part to be replaced; and a mounting portion for removably mounting the part holding unit on an image forming apparatus;

wherein the part housing container comprises a main body for receiving the part to be replaced, and a lid which openably closes the housing space with respect to the main body.

2. A part-replacement aid tool according to claim 1 wherein the part housing container also serves as a packaging container which houses a new replacement part.

3. A part-replacement aid tool according to claim 1, further comprising a reception portion arranged such that when the part-replacement aid tool is attached to the image forming apparatus, the reception portion receives, under a path of the part to be replaced from a fitting portion of the part to be replaced in the image forming apparatus to the part holding unit, an object falling from the part to be replaced.

4. A part-replacement aid tool used for aiding in a replacement operation of a part to be replaced in an image forming apparatus, comprising:

a part holding unit for holding a part to be replaced, wherein the part holding unit is a part housing container having a housing space for housing the part to be replaced; and a mounting portion for removably mounting the part holding unit on an image forming apparatus;

wherein the part to be replaced is a part that contains toner inside thereof.

5. A part-replacement aid tool used for aiding in replacement operation of a part to be replaced in an image forming apparatus, comprising:

a part holding unit for holding a part to be replaced; and a mounting portion for removably mounting the part holding unit on an image forming apparatus, wherein the part to be replaced is a toner cartridge.

6. A part-replacement aid tool used for aiding in a replacement operation of a part to be replaced in an image forming apparatus, comprising:

a part holding unit for holding a part to be replaced; and a mounting portion for removably mounting the part holding unit on an image forming apparatus, wherein the mounting portion includes an engagement hole to be engaged with a hook disposed at the image forming apparatus; and wherein the part to be replaced is a part that contains toner inside thereof.

7. A part-replacement aid tool according to claim 6, wherein the engagement hole includes a fitting hole capable of receiving the hook, and a coming-out preventing hole which communicates with the fitting hole and which has such a width as to prevent the hook from coming out.

8. An image forming apparatus comprising:

an engagement portion engageable with and disengageable from a mounting portion of a part-replacement aid tool having a part holding unit for holding a part to be replaced, a main body housing, and an image forming unit having a photoreceptor, a developing unit and a toner cartridge fitting portion, the part to be replaced being a toner cartridge removably mounted on the toner cartridge fitting portion.

9. An image forming apparatus according to claim 8, wherein the engagement portion is fixed to a main body of the image forming apparatus at least at a time of replacement of the part to be replaced.

10. An image forming apparatus according to claim 8, further comprising a main body housing, the engagement portion being disposed at the main body housing.

11. An image forming apparatus according to claim 8, further comprising a main body housing, and a unit removably attached to the main body housing, the engagement portion being disposed at the unit.

12. An image forming apparatus according to claim 8, wherein the engagement portion is disposed at the image forming unit.

13. An image forming apparatus according to claim 8 wherein the engagement portion is disposed such that the part holding unit of the aid tool is positioned in the vicinity of the fitting portion for the part to be replaced.

14. An image forming apparatus comprising:

an engagement portion engageable with and disengageable from a mounting portion of a part-replacement aid tool having a part holding unit for holding a part to be replaced, wherein one of the mounting portion and the engagement portion is a hook, and the other of the mounting portion and the engagement portion is an engagement hole which is engaged with a hook; and wherein the part to be replaced is a part that contains toner inside thereof.

* * * * *